United States Patent [19]

Hirakura et al.

[11] Patent Number: 4,474,455

[45] Date of Patent: Oct. 2, 1984

[54] ELECTROPHOTOGRAPHIC COPYING PROCESS AND APPARATUS HAVING MEANS FOR MONITORING A FATIGUE RECOVERY TIME

[75] Inventors: Kohji Hirakura, Yokohama; Chikara Imai; Kazuhiro Kimura, both of Tokyo, all of Japan

[73] Assignee: Ricoh Company, Ltd., Japan

[21] Appl. No.: 396,364

[22] Filed: Jul. 8, 1982

[30] Foreign Application Priority Data

Jul. 8, 1982 [JP] Japan ..... 56-105661

[51] Int. Cl.[3] ..... G03G 21/00

[52] U.S. Cl. ..... 355/14 R; 355/3 R; 355/77; 430/31

[58] Field of Search ..... 355/14 R, 3 R, 11, 15, 355/77; 430/31

[56] References Cited

U.S. PATENT DOCUMENTS

| | | | |
|---|---|---|---|
| 4,142,792 | 3/1979 | Satomi et al. | 355/14 R |
| 4,260,238 | 4/1981 | Kozuka et al. | 355/3 R |
| 4,286,865 | 9/1981 | Satomi et al. | 355/14 CU |
| 4,380,386 | 4/1983 | Yasuda et al. | 355/3 R |

*Primary Examiner*—R. L. Moses

*Attorney, Agent, or Firm*—Guy W. Shoup

[57] ABSTRACT

An electrophotographic copying process and apparatus fast in operation and capable of making reproduced images having substantially the same image density is provided. In accordance with the present invention, pre-exposure is carried out only when a photosensitive member is to be used for image formation after elapsing a predetermined time period during which the photosensitive member has been kept unused. The present invention is fast in operation and minimal in power consumption because the pre-exposure is skipped when unnecessary. However, since pre-exposure is effected when necessary, the image density may be maintained at constant.

17 Claims, 4 Drawing Figures

ELECTROPHOTOGRAPHIC COPYING PROCESS AND APPARATUS HAVING MEANS FOR MONITORING A FATIGUE RECOVERY TIME

BACKGROUND OF THE INVENTION

1. Field of the Invention

This invention relates to electrophotographic copying technology and in particular to an electrophotographic copying process and apparatus which allows to obtain a uniform image density in multiple reproduction and to speed up the overall copying operation by minimizing the preparatory step of the copying operation as much as possible.

2. Description of the Prior Art

In electrophotographic copying technology, the same photosensitive member is repetitively used, and while the photosensitive member is subjected to the steps of charging, exposing to a light image and discharging, charges such as electrons and holes are captured in the traps present in the photosensitive member to cause the so-called fatigue phenomenon, thereby increasing the capacitance of the photosensitive member. It is disadvantageous when the capacitance of the photosensitive member changes in this manner because it will cause the charging potential on the surface of the photosensitive member to vary, in effect, its sensitivity thereby varying the image density from one copy image to another.

For this reason, various techniques have hitherto been proposed to obviate the problem of fluctuations in image density; however, none of them is satisfactory and they still suffer from disadvantages as described below. First, in accordance with Japanese patent publication No. 49-4337 and Japanese Patent Laid-open No. 53-148444, there is proposed a technique of carrying out pre-exposure of the whole surface of the photosensitive member prior to the charging step in continuous copying operation. In such prior art, however, only the light amount of pre-exposure is controlled in accordance with the degree of fatigue of the photosensitive member in a series of successive copying operations and pre-exposure is always carried out at the beginning of each copying operation in several successive copying operations, so that unnecessary power is expended.

Moreover, Japanese Patent Laid-open No. 55-93188 proposes to limit the idle rotations of a photosensitive drum for the above-described pre-treatment to a single rotation; on the other hand, Japanese Patent Laid-open No. 56-54473 proposes to carry out only light irradiation to a photosensitive member while the apparatus is in a standby state. However, in the former case, there is difficulty in controlling light irradiation at the seam during a single rotation and also in having the whole photosensitive surface fatigued uniformly. The latter case is also disadvantaged in that the fatigue produced only by light irradiation is not necessarily sufficient in preventing the sensitivity of a photosensitive member from fluctuating. Accordingly none of the prior art is satisfactory and there still has been a need for further improvements in a reproduction technique.

SUMMARY OF THE INVENTION

It is therefore a primary object of the present invention to provide an improved electrophotographic copying process and apparatus.

Another object of the present invention is to provide an electrophotographic copying process and apparatus capable of providing a uniform image density in multiple copies.

A further object of the present invention is to provide an electrophotographic copying process and apparatus which allows to obtain a copy quickly.

A still further object of the present invention is to provide an electrophotographic copying process and apparatus which is economically advantageous in power consumption.

A still further object of the present invention is to provide an electrophotographic copying process and apparatus which is controlled to carry out a pre-exposure step only when required thereby allowing to obtain multiple copies substantially the same in image density at an increased speed.

A still further object of the present invention is to provide an electrophotographic copying process and apparatus which is simple in structure.

In accordance with one aspect of the present invention, there is provided an electrophotographic copying process comprising a series of reproduction steps to be carried out to the surface of a photosensitive member including uniform charging, image exposure, developing and transferring, characterized in that said series of reproduction steps is carried out immediately if a following series of reproduction steps is to be initiated within a predetermined time period from the completion of the preceding series of reproduction step. A uniform light is irradiated to the surface of said photosensitive member as a pre-step if the following series of reproduction steps is to be initiated after a predetermined time period from the completion of the preceding series of reproduction steps. That is, in accordance with the present process, pre-exposure is carried out by irradiating a uniform light to the whole surface of a photosensitive member prior to the initiation of a series of reproduction steps including uniform charging, image exposure, developing and transferring, thereby filling the traps with charges to have the photosensitive member fatigued to maintain its sensitivity in a desired range to keep the image density in multiple copies unchanged, and yet such a pre-exposure is carried out only when a predetermined time period has elapsed as from the completion of the last preceding series of reproduction steps. In this case, it is preferable to have the photosensitive member uniformly charged prior to the step of irradiation of a uniform light because the photosensitive member may be fatigued more effectively by so doing.

In accordance with another aspect of the present invention, there is provided an electrophotographic copying apparatus comprising uniformly charging means, image exposing means, developing means, transferring means and cleaning means, wherein a series of reproduction steps is carried out to the surface of a photosensitive member and an irradiating means capable of irradiating a uniform light to the surface of said photosensitive member connected to a control means which controls various components of said copying apparatus. A print switch for initiating said reproduction steps and a main switch are connected to said control means whereby turning on of said main switch establishes connection to a power source thereby operating said irradiating means in accordance with an instruction from said control means to carry out a pre-treatment step of said copying apparatus. The main switch is turned off in accordance with an instruction from said control means if a predetermined time period has elapsed upon completion of said pre-treatment step or if a predetermined time period has elapsed upon completion of the last series of reproduction steps after turning on of said print switch.

In accordance with a further aspect of the present invention, there is provided an electrophotographic copying apparatus comprising irradiating means capable of irradiating a uniform light to the surface of a photosensitive member and connected to control means for controlling various components of said copying apparatus, and a main switch, a self-holding type operate switch and a print switch, all connected to said control means, said print switch initiating a series of reproduction steps when turned on after turning on of said operate switch. The irradiating means is operated in accordance with an instruction from said control means to carry out a pre-treatment step of said copying apparatus when said main switch is turned on to establish connection to a power source, said irradiating means being operated in accordance with an instruction from said control means to carry out said pre-treatment step when said operate switch is turned on after having said main switch turned on, and said operate switch being turned off in accordance with an instruction from said control means when a predetermined time period has elapsed upon completion of the pre-treatment step due to turning on of said operate switch or when a predetermined time period has elapsed upon completion of the last reproduction process due to turning on of said print switch.

In carrying out the pre-treatment step in either of the copying apparatus described above, it is preferable to have the surface of the photosensitive member charged by the uniformly charging means prior to the step of irradiating a uniform light by the irradiating means. In the case where the photosensitive member is formed by $AS_2Se_3$, a reddish light having the wavelength ranging from 600 to 700 nm may be preferably used as a uniform light to be irradiated by the irradiating means, and such a light may be commonly used by a discharging device for removing the residual charges after a series of reproduction steps. Furthermore, in the case where a photosensitive drum is used, such an irradiating means may be disposed at an appropriate position along the periphery of the drum, and a plurality of such irradiating means may be disposed at appropriate locations to reduce the overall irradiating time period.

Other objects, advantages and novel features of the present invention will become apparent from the following detailed description of the invention when considered in conjunction with the accompanying drawings.

DESCRIPTION OF THE PREFERRED EMBODIMENTS

Typically, a photosensitive member is attached to the periphery of a drum which is driven to rotate at a constant speed and it comprises a conductive layer made of a material such as Al and a photoconductive layer made of a material such as $As_2Se_3$ or CdS formed on the conductive layer thereby presenting a photosensitive surface on which an image is to be formed. The conductive layer is attached to the periphery of the drum and it is typically grounded. Charges are applied to the outer surface of the photoconductive layer by means of a charging device to uniformly charge the photoconductive layer, and, then, these surface charges are selectively removed by exposing the uniformly charged surface to an image light corresponding to an original image thereby forming an electrostatic latent image. Thereafter, the surface of the photosensitive member is subjected to the steps of developing, transferring and cleaning, and the residual charges on the surface are removed by a discharging device. During a process step such as image exposure and discharging, those charges which are generated or migrate in the photoconductive layer are partly trapped and increase the capacitance of the photosensitive member, so that the dark portion potential of the photosensitive member goes down and its sensitivity changes.

Figure 1:
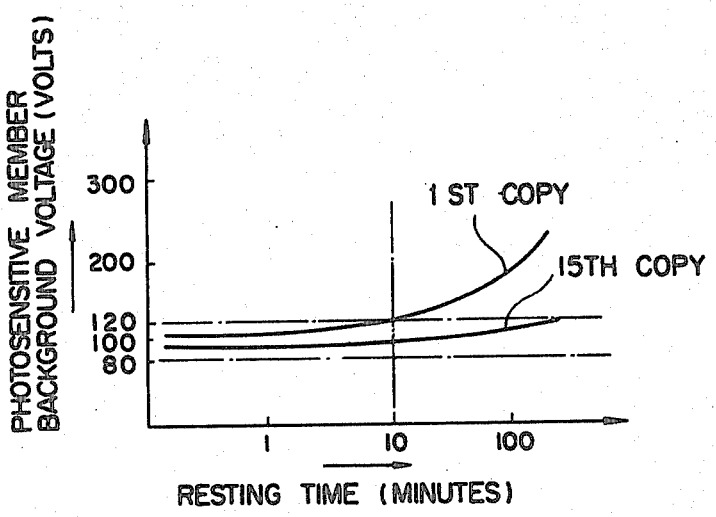
FIG. 1 is a graph showing the experimentally obtained relationship between the background voltage of a photosensitive member and the resting time for the case where a single copy has been made and for the case where 15 copies have been made.

Nonetheless, the trapped charges in the photoconductive layer are released while the photosensitive member is at rest, i.e., while the reproduction process including the above-described image exposure and discharging is not in progress, so that the capacitance of the photosensitive member gradually recovers. The variation in the background voltage under the circumstances is shown in FIG. 1 with its abscissa taken for the resting time of the photosensitive member in minutes and its ordinate taken for the background voltage of the photosensitive member. As shown, the curve of "1st Copy", shows the variation in background voltage when the photosensitive member is set at rest after making a single copy, i.e., carrying out the reproduction process only once, after having kept the photosensitive member unused for a long period of time. On the other hand, the curve of "15th Copy" similarly shows the variation in background voltage after making 15 copies continuously. It may be understood from FIG. 1 that the background voltage goes down as the reproduction process is repeated more and an equilibrium condition is reached when multiple copies in the order of 15 are to be made continuously. However, as shown in FIG. 1, if the photosensitive member is set at rest, its background potential gradually increases because trapped charges in the photoconductive layer gradually dissipate.

As described above, the background potential of the photosensitive member fluctuates depending upon use or non-use condition of the photosensitive member and the length in time of such use or non-use condition, and such a hysteresis characteristic of the photosensitive member causes the image density to fluctuate. For this reason, in accordance with the prior art, a pre-exposure step is carried out to have the photosensitive member fatigued to set the background potential in the neighborhood of the equilibrium condition prior to the initiation of the ordinary reproduction process. However, such a prior art technique is disadvantageous because the time period required for the pre-exposure step is added as a waste time for each reproduction process as discussed previously.

Now, as may be best understood from FIG. 1, which is a graph showing the experimental results obtained by the present inventors with respect to an $As_2Se_3$ photosensitive layer, the variation in background potential while the photosensitive member is not in use is rather small for a period of time upon having the photosensitive member set at rest and the variation becomes increasingly steeper as the resting time increases beyond such a period of time. It will also be easily understood that the more a number of copies have been made in succession, the less the variation in background potential. For example, as compared with the curve of "15th Copy", the curve of "1st Copy" shows more rapid changes in the background potential.

It has been found that as long as the background voltage remains in the range approximately ±20% of a reference level, i.e., 100±20 V in the case of FIG. 1, fluctuations of the image density in transferred images caused by the above-described fluctuations in sensitivity of the photosensitive member are not visually noticeable and can be neglected. Thus, when use is made of $As_2Se_3$ for a photoconductive layer, the resting of a photosensitive member for 10 minutes or less upon completion of the last reproduction process does not bring about any significant change in image density even for the case of a single reproduction. It will thus be understood that a pre-treatment step such as pre-exposure is not necessary as long as the next reproduction process is initiated within a predetermined time period, i.e., 10 minutes in the case of FIG. 1, as from the completion of the last reproduction process. The present invention has been made in view of the above, and it is so structured that the necessity of carrying out the sensitivity stabilization treatment such as by irradiating a uniform light to the surface of the photosensitive member is determined in accordance with the length of the resting time of the photosensitive member, thereby allowing to make the image density uniform and at the same time to speed up the reproduction operation with minimizing power consumption.

Figure 2:
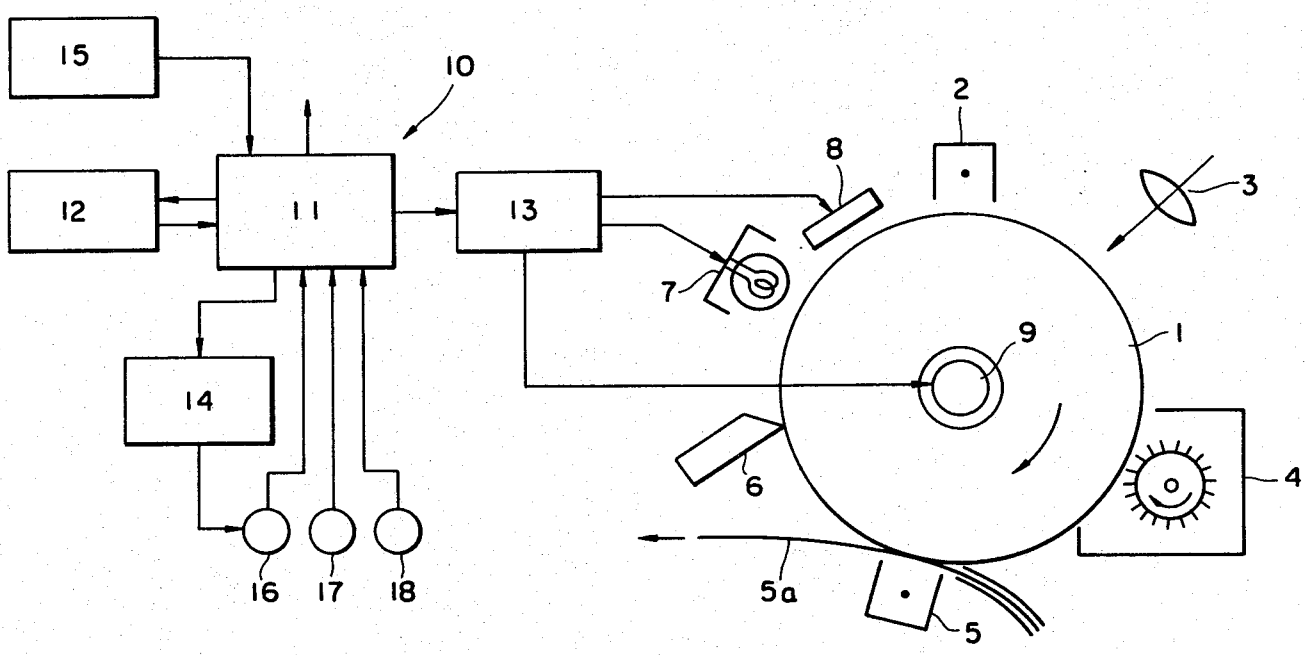
FIG. 2 is a schematic illustration partly in blocks showing one embodiment of the present invention.

Referring now to FIG. 2, there is schematically shown one example of an electrophotographic copying apparatus to which the present invention has been applied. To the left in FIG. 2 is shown in blocks a control device, generally indicated by 10, for controlling various components of the copying apparatus, and to the right in FIG. 2 is shown a photosensitive drum 1 and various process means disposed therearound.

The photosensitive drum 1 is rotatably supported and is driven to rotate in the direction indicated by the arrow by means of a motor 9. The photosensitive drum 1 is constructed such that a conductive layer is formed on the outer periphery of a drum and a photoconductive layer of $As_2Se_3$ is formed on the conductive layer, which is grounded. Along the peripheral surface of the photosensitive drum 1 are disposed a charging device 2, an image exposing device 3, a developing device 4, atransferring device 5 and a cleaning device 6 in the order mentioned in the direction of the rotation of the drum 1. Accordingly, as the photosensitive drum 1 rotates, the surface of the photosensitive member is uniformly charged, for example, to positive polarity by means of the charging device 2 and then an original image is exposed by the image exposing device 3 to selectively remove the charges thereby forming an electrostatic latent image.

The electrostatic latent image thus formed is visualized when toner particles charged to the polarity opposite to the polarity of the electrostatic latent image are supplied by the developing device 4. Then the visualized or toner image is transferred to transfer paper 5*a* by the transferring device 5 which supplies positive corona ions to the back side of the transfer paper 5*a*. Thereafter the residual toner particles remaining on the surface of the drum 1 are removed by the cleaning device 6 such as a blade cleaner.

In accordance with the present invention, a fatigue device 7 and a discharging device 8 are disposed in the neighborhood of the peripheral surface of the photosensitive drum 1 between the cleaning device 6 and the charging device 2. These devices 7 and 8 extend across the width of the peripheral surface of the drum 1. The fatigue device 7 is preferably comprised of means for irradiating a uniform light to the photosensitive member in order to have the photosensitive member fatigued by trapping charges in its photoconductive layer, and, preferably, it is so structured to irradiate light having a relatively long wavelength in the range from 600 to 700 nm, which may penetrate deep into the photoconductive layer. On the other hand, the discharging device 8 is preferably comprised of means for irradiating a uniform light to remove residual charges from the photosensitive surface and it is preferably so structured to irradiate light having a relatively short wavelength ranging from 450 to 550 nm so as to neutralize the residual charges on the surface of the photosensitive member by generating charges in the neighborhood of the surface of the photosensitive member, which can be recombined with the residual charges. It is to be noted that use may be made of an exposure lamp or plate-type light emitting element which can emit light having the required wavelength in forming the fatigue device 7 and the discharging device 8.

Now, a description will be had with respect to the control device 10, which includes a central processing unit (hereinafter, also referred to as CPU) 11 storing required programs and supplying instruction signals to various components of the copying apparatus. To the CPU 11 are connected three switches: an operate switch 16, a print switch 17 and a main switch 18, all of which may be provided at a location such as the operating panel of a copying machine. Also connected to the CPU 11 is a driving circuit 13 which operates the fatigue device 7, charging device 8 and motor 9 for rotating the photosensitive drum 1 in accordance with instructions supplied from the CPU 11.

The main switch 18 is a power source switch. On the other hand, when the operate switch 16 is turned on after having the main switch 18 turned on, the pre-treatment step is carried out to set the copying apparatus ready for executing the reproduction process. Moreover, if the print switch 17 is turned on within a predetermined time period upon turning on of the operate switch 16 or within a predetermined time period upon completion of the last reproduction process, the reproduction process is initiated immediately without carrying out the pre-treatment step.

Connected to the CPU 11 is a counter circuit 12, which starts counting upon receiving a print end signal produced by stoppage the motor 9 and which stops counting upon receiving a print start signal produced when the motor 9 is operated, thereby resetting the counted value to an initial value. The counted value in the counter circuit 12 is supplied as an input to the CPU 11, and if the counted value of the counter circuit 12 exceeds a predetermined time period, for example 10 minutes in the present embodiment, the CPU 11 supplies an instruction signal to an automatic shutoff circuit 14 thereby causing the operate switch 16 to be turned off. As a result, even if the print switch 17 is turned on under the condition, the reproduction process is not carried out. Thus, in order to make a copy, the operate switch 16 must first be turned on again.

Figure 3:
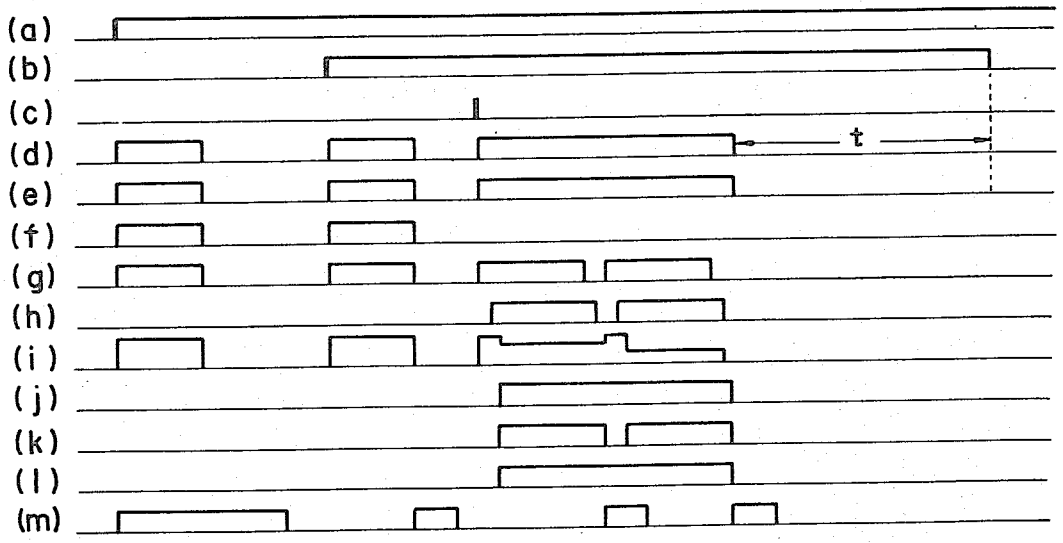
FIG. 3 is a timing chart useful for explaining the operation of the apparatus shown in FIG. 2.

Next, referring to FIGS. 3 (*a*) through (*m*), the operation of the control unit 10 and its relation with the other components of the present copying apparatus will be described in association with the turning-on operation of each of the switches 16, 17 and 18. FIG. 3 is a timing chart with its abscissa taken for time and FIGS. 3(*a*) through (*m*) show the operating conditions of the following components: (a) main switch 18; (b) operate switch 16; (c) print switch 17; (d) motor 9 (one revolution of the photosensitive drum); (e) discharging device 8; (f) fatigue device 7; (g) charging device 2; (h) image exposing device 3; (i) developing bias; (j) transferring device 5; (k) supply of transfer paper 5*a;* (l) cleaning device 6; and (m) fixing device.

Upon receiving a turn-on signal from the main switch 18, the CPU 11 sends a signal to drive the motor 9 for some 10 seconds to rotate the photosensitive drum 1, and during the time period in which the photosensitive drum 1 is in rotation, the fatigue device 7 and the discharging device 8 are operated by the CPU 11 to irradiate a uniform light thereby causing the photosensitive member fatigued and eliminating possibly existing charges from the photosensitive surface. Moreover, the CPU 11 also supplies operating signals to the charging device 2, a developing bias application unit (not shown) of the developing device 4 and the fixing device (not shown), so that during the time period in which the photosensitive drum 1 is in rotation, the photosensitive surface is uniformly charged by the charging device 2 and at the same time the developing bias voltage of the developing device 4 is set at a predetermined value with operation of the fixing device for a predetermined time period to execute its pre-heat step.

When the operate switch 16 is turned on, the CPU 11 sends a signal to the driving circuit 13 to drive the motor 9 thereby rotating the photosensitive drum 1 twice or more (approximately 4 to 5 seconds or more). During this rotation, light is uniformly irradiated to the photosensitive surface by means of the fatigue device 7 and the discharging device 8 and at the same time the photosensitive surface is charged by the charging device 2 while setting the developing bias of the developing bias application unit of the developing device 4 to a predetermined value. Then, somewhat delayed from these operations, the fixing device is operated for a predetermined time period for pre-heating.

When a turn-on signal is supplied from the print switch 17, the CPU 11 sends out a signal to keep the photosensitive drum 1 driven to rotate by the motor 9 for a time period determined by the number of multiple copies (two consecutive copies in the embodiment shown) set by a repeat counter 15 and thus the reproduction process is initiated. That is, uniform charging is carried out by the charging device 2 and an original image is exposed by the image exposing device 3 with a timing slightly delayed from the uniform charging. Besides, the developing bias voltage is set and the transferring device 5 and the cleaning device 6 are set operative to transport the transfer paper 5*a*. Furthermore, the discharging device 8 is operated while the photosensitive drum 1 is in rotation to remove the residual charges from the photosensitive surface.

Then, in the case where a predetermined time period t, e.g., 10 minutes, has elapsed without carrying out the next following reproduction process upon termination of rotation of the photosensitive drum 1, or completion of the reproduction process, the automatic shutoff circuit 14 is operated in accordance with instruction from the counter circuit 12 and the CPU 11 to cause the operate switch 16 to be turned off. Therefore, even if the print switch is turned on, for example, by manual operation under the circumstances, the reproduction process does not proceed. In this case, the operate switch 16 must first be turned on to carry out the pretreatment of uniform light irradiation in order to have the photosensitive member fatigued to a sufficient level. When the main switch 18 is turned off manually, the power source circuit of the copying apparatus is disconnected.

As described above, when the main switch 18 or the operate switch 16 is turned on, the photosensitive drum 1 is rotated once or over one revolution whereby the surface of the photosensitive member is uniformly charged by the charging device 2 and light is uniformly irradiated by the fatigue device 7 and the discharging device 8 to have the photosensitive member fatigued. The fatigue device 7 applies light having a long wavelength to the photosensitive member so that charges are generated and trapped inside the photoconductive layer. It is to be noted that if the photosensitive surface is uniformly charged prior to the application of uniform light of a long wavelength, the photosensitive member may be fatigued more effectively. That is, in the case of absence of an electric field, electron-hole pairs generated by photon excitation inside the photoconductive layer have a higher probability of recombination and thus charges are less likely to be trapped. On the other hand, under the presence of an electric field, electron-hole pairs are more efficiently separated from each other so that charges are more likely to be trapped before being recombined thereby allowing to obtain a stable fatigue.

As described above, in accordance with the present invention, as long as the print switch 17 is turned on within a predetermined time period upon turning on of the operate switch 16 or within a predetermined time period upon completion of the last reproduction process, the next reproduction process including such steps as uniform charging, image exposure, developing, transferring, cleaning and discharging is immediately initiated without carrying out the pre-treatment or pre-exposure step. The photosensitive member remains sufficiently fatigued during such a predetermined time period and thus the background potential stays relatively low in the neighborhood of the equilibrium condition. As a result, changes in the background potential are very small and excellent copies having substantially the same image density may be obtained without the step of pre-exposure. Incidentally, when the background voltage is low, the developing bias voltage (cf. FIG. 3 (*i*) ) must be set at a low value; however, since the background voltage of the first copy is somewhat higher, it is preferable to set the developing bias voltage a little higher by 30–50 V correspondingly.

In the case where the next reproduction process is to be initiated before elapsing a predetermined time period t from the termination of the last reproduction process, it will be initiated promptly upon turning on of the print switch 17. On the contrary, if a predetermined time period t has elapsed before the operation of the print switch 17, the reproduction process cannot be carried out even if the print switch 17 has been turned on, and the operate switch 16 must be turned on prior thereto. When the operate switch 16 is turned on, light is uniformly applied to the photosensitive member to have it fatigued as a pre-treatment step and then there is established the condition in which the reproduction process may be carried out by turning the print switch 17 on.

It is to be noted that the operate switch 16 is turned off by the automatic shuttoff circuit 14 under the condition that a predetermined time period t has elapsed without operation of the motor 9 after receiving a print end signal produced when the operation of the motor 9 is terminated. Thus, in the case where a predetermined time period t has elapsed without turning the print switch 17 on after having the operate switch 16 turned on, the operate switch 16 is turned off, and, therefore, in order to initiate the next following reproduction process, the operate switch 16 must first be turned on. It may be so structured that both of the fatigue device 7 and the discharging device 8 are operated when the print switch 17 is turned on. It is also to be noted that if the operate switch 16 is turned on before elapsing a predetermined time period t upon completion of the fatigue treatment by the fatigue device 7 and the like when the main switch 18 has been turned on, it is not always necessary to operate the fatigue device 7 and the like even if the operate switch 16 is turned on.

As described above, when making multiple copies in a continuous fashion in accordance with the present invention, no idle rotation of the photosensitive drum 1 for uniform light irradiation takes place, so that the reproduction operation may be carried out rapidly. And, since the pre-treatment step is used only when the background voltage of the photosensitive member exceeds a predetermined level, seemingly contradictory requirements of speeding up of the reproduction operation and making copies of uniform image density are satisfied at the same time.

Figure 4:
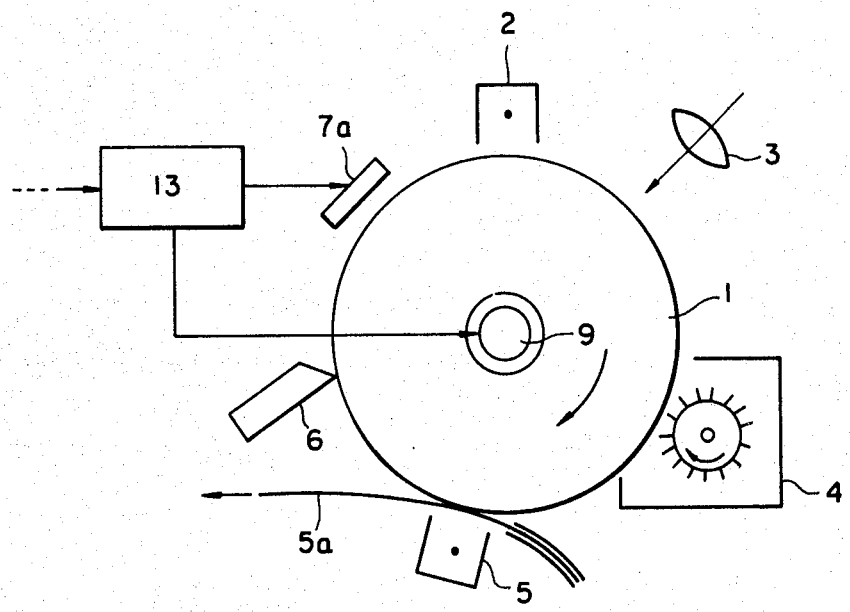
FIGS. 4 and 5 are schematic illustrations showing other embodiments of the present invention.
Figure 5:
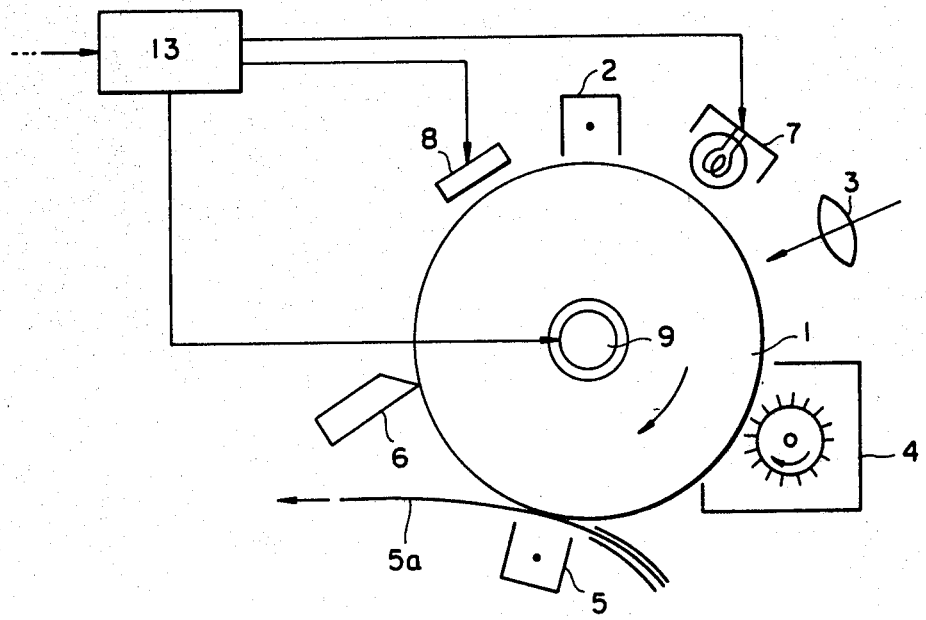

Referring now to FIGS. 4 and 5, other embodiments of the present invention will be described. It is to be noted that, as practiced throughout the present specification, like numerals indicate like elements. The embodiment in FIG. 4 differs from the embodiment shown in FIG. 1 in the means for irradiating a uniform light. That is, in the embodiment shown in FIG. 4, there is provided a fatigue/discharging device 7*a* which applies light having an intermediate wavelength between the long wavelength (600–700 nm) and the short wavelength (450–550 nm) to the surface of the photosensitive member instead of the fatigue device 7 and the discharging device 8 in the embodiment of FIG. 1. This single component fatigue/discharging device 7*a* is operated to have the photosensitive member fatigued when the main switch 18 or the operate switch 16 is turned on, and it is operated to discharge the photosensitive member when the print switch 17 is turned on, thereby making the overall construction simplified.

On the other hand, in the embodiment shown in FIG. 5, the fatigue device 7 is disposed between the charging device 2 and the image exposure device 3. In this manner, the fatigue device 7 may be disposed at an appropriate location along the periphery of the photosensitive drum 1, and, furthermore, two or more fatigue devices 7 may be disposed at different locations along the periphery of the drum 1 thereby allowing to shorten the time period required for the idle rotation of the drum 1 during which the photosensitive member is fatigued by uniform irradiation of light. In this case, however, it should be so structured that the fatigue device 7 is not operated when the print switch 17 is turned on.

As described in detail above, in accordance with the present invention, the image density is made uniform since the sensitivity of a photosensitive member is stabilized by uniform light irradiation when required, and, furthermore, higher speed in the overall reproduction operation is obtained since the step of uniform light irradiation is skipped if not necessary.

While the above provides a full and complete disclosure of the preferred embodiments of the present invention, various modifications, alternate constructions and equivalents may be employed without departing from the true spirit and scope of the invention. For example, the function of the operate switch may be incorporated into the main switch and in this case, the operate switch may be omitted. Moreover, if a photosensitive member is to be uniformly charged prior to uniform light irradiation in order to have the photosensitive member fatigued effectively, either one or both of the corona discharging devices 2, 5 may be operated in accordance with a signal from the CPU 11. Alternatively, a separate corona discharging device may be provided between the cleaning device 6 and the fatigue device 7 for that purpose. Therefore, the above description and illustration should not be construed as limiting the scope of the invention, which is defined by the appended claims.

What is claimed is:

1. An electrophotographic copying process comprising the steps of:

charging a photosensitive member uniformly;

exposing a light image to said photosensitive member to selectively dissipate the charge thereby forming an electrostatic latent image;

developing said electrostatic latent image with toner thereby converting said latent image into a visual toner image;

transferring said toner image to transfer paper; and pre-treating said photosensitive member to cause said photosensitive member to be sufficiently fatigued only when the copying steps are to be carried out after a predetermined time period following a previous copying operation, said time period being determined by a fatigue recovery characteristic of said photosensitive member.

2. The process of claim 1 further comprising the step of cleaning said photosensitive member after the step of transferring to remove any residual toner remaining on said photosensitive member.

3. The process of claim 1 wherein said photosensitive member is fatigued by irradiating light uniformly to said photosensitive member.

4. The process of claim 3 wherein said photosensitive member is charged before uniform light irradiation.

5. The process of claim 1 wherein said photosensitive member comprises a photoconductive layer made of $As_2Se_3$ and said predetermined time period is 10 minutes.

6. An electrophotographic copying apparatus comprising:

a photosensitive member;

image forming means for forming a toner image on said photosensitive member;

transfer means for transferring said toner image to transfer paper;

pre-treatment means for pre-treating said photosensitive member to cause said photosensitive member to be sufficiently fatigued when required prior to the initiation of forming a toner image on said photosensitive member; and control means for controlling various components of said apparatus including said pre-treatment means such that said pretreatment means is operated only when said toner image is to be formed on said photosensitive member after a predetermined time period following a previous copying operation, said time period being determined by a fatigue recovery characteristic of said photosensitive member.

7. The apparatus of claim 6 wherein said pretreatment means includes means for irradiating a uniform light to said photosensitive member so as to have said photosensitive member fatigued sufficiently.

8. The apparatus of claim 7 wherein said uniform light has a wavelength which is effective in having said photosensitive member fatigued to a sufficient level to keep the background potential at the surface of said photosensitive member in the neighborhood of the equilibrium condition.

9. The apparatus of claim 6 wherein said pre-treatment means includes first irradiating means for irradiating a uniform light having a first wavelength and second irradiating means for irradiating a uniform light having a second wavelength.

10. The apparatus of claim 9 wherein the uniform light having a first wavelength penetrates deep into the photoconductive layer of said photosensitive member and the uniform light having a second wavelength is substantially absorbed at the surface of said photoconductive layer.

11. The apparatus of claim 6 wherein said photosensitive member comprises a photoconductive layer made of $As_2$ $Se_3$ and said predetermined time period is 10 minutes.

12. An electrophotographic copying apparatus comprising:

a photosensitive drum including a rotatably supported drum and a photosensitive member provided on the periphery of said drum;

driving means for driving said photosensitive drum into rotation;

image forming means for forming a toner image on said photosensitive member;

transfer means for transferring said toner image to transfer paper;

pre-treatment means for pre-treating said photosensitive member to cause said photosensitive member to be sufficiently fatigued when required prior to the initiation of forming a toner image on said photosensitive member; and control means for controlling various components of said apparatus including said pre-treatment means, said control means operating said pre-treatment means after a predetermined time period following a previous copying operation, said time period being determined by a fatigue recovery characteristic of said photosensitive member.

13. An electrophotographic copying apparatus comprising:

a photosensitive drum including a rotatably supported drum and a photosensitive member provided on the periphery of said drum;

driving means for driving said photosensitive drum into rotation at constant speed;

means for uniformly charging said photosensitive drum;

means for exposing a light image to said photosensitive drum thereby forming an electrostatic latent image thereon;

means for developing said latent image to form a toner image;

means for transferring said toner image to transfer paper;

means for irradiating a uniform light to said photosensitive drum to cause said photosensitive member to be sufficiently fatigued;

a central processing unit (CPU) for controlling various components of said apparatus;

a counter connected to said CPU which starts counting when said driving means has stopped after a previous copying operation and which sends a time-over signal to said CPU when a predetermined time period determined by a fatigue recovery characteristic of said photosensitive member has been counted;

a first switch connected to said CPU for providing a turn-on signal for starting the image forming operation of said apparatus without the operation of said means for irradiating;

a second switch connected to said CPU for carrying out a preparatory step including the operation of said means for irradiating said second switch holding the on-state once turned on and said CPU accepting the turn-on signal from said first switch only when said second switch is on; and automatic shutoff means connected between said CPU and said second switch for turning said second switch off when said CPU has received said time-over signal from said counter.

14. The apparatus of claim 13 further comprising a third switch connected to said CPU for connecting to a power source when turned on.

15. The apparatus of claim 14 wherein the function of said third switch is integrated into said second switch.

16. The apparatus of claim 13, 14 or 15 further including means for cleaning said photosensitive member for removing residual toner after transferring the toner image to transfer paper.

17. The apparatus of claim 13 wherein said CPU resets said counter when said photosensitive drum is driven by said driving means within said predetermined time period by turning on of said first switch.

* * * * *

UNITED STATES PATENT AND TRADEMARK OFFICE

CERTIFICATE OF CORRECTION

PATENT NO. : 4,474,455

DATED : October 2, 1984

INVENTOR(S) : Kohji Hirakusa, Chikara Imai, Kazuhiro Kimura

It is certified that error appears in the above-identified patent and that said Letters Patent is hereby corrected as shown below:

On the title page

The Foreign Application Priority Data is changed to July 8, 1981.

Signed and Sealed this

Twenty-eighth Day of March, 1989

*Attest:*

DONALD J. QUIGG

*Attesting Officer*

*Commissioner of Patents and Trademarks*